US006598957B2

(12) United States Patent
Yamamoto et al.

(10) Patent No.: US 6,598,957 B2
(45) Date of Patent: Jul. 29, 2003

(54) RECORDING HEAD AND PROCESS FOR PRODUCING THE SAME

(75) Inventors: Ryoichi Yamamoto, Kanagawa (JP); Masao Mitani, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/054,707

(22) Filed: Jan. 24, 2002

(65) Prior Publication Data

US 2002/0097296 A1 Jul. 25, 2002

(30) Foreign Application Priority Data

Jan. 25, 2001 (JP) ..... 2001-016738

(51) Int. Cl.[7] ..... B41J 2/135; B41J 2/14; H04R 17/00

(52) U.S. Cl. ..... 347/45; 347/44; 347/47; 29/25.35

(58) Field of Search ..... 347/20, 44, 45, 347/47; 427/523, 526; 29/890.1, 25.35

(56) References Cited

U.S. PATENT DOCUMENTS 6,474,780 B1 * 11/2002 Kubota et al. ..... 347/45

FOREIGN PATENT DOCUMENTS

| | | | | |
|---|---|---|---|---|
| JP | 06-316079 | | 11/1994 | |
| JP | 10-151744 | | 6/1998 | |
| JP | 10151744 A | * | 6/1998 | ..... B41J/2/05 |
| JP | 2000-17091 | | 1/2000 | |
| JP | 2000017091 A | * | 1/2000 | ..... C08J/7/00 |

OTHER PUBLICATIONS

Proceedings of the Fifteenth Symposium on Surface Layer Modification by Ion Implantation "The effects of Ar Ion--Implantation on Hydrophobic Fluorine Polymer" Nov. 19, 1999—English language abstract included.

"Latest Advances in Surface Modification of Fluoropolymers", Murakami and Uemori, Nitto Giho, May, 1996—English language abstract included.

* cited by examiner

*Primary Examiner*—Judy Nguyen
*Assistant Examiner*—An H. Do
(74) *Attorney, Agent, or Firm*—Whitham, Curtis & Christofferson, PC

(57) ABSTRACT

The recording head of an ink-jet printer includes a main body having ink ejection devices and a device for driving the ink ejection devices independently and an orifice plate attached to the main body having ink ejection orifices opened in positions corresponding to the ink ejection devices. At least one side of the orifice plate is made of fluoroplastic, a surface of one side of the orifice plate made of the fluoroplastic has been treated to become more water-repellent than a bulk material of the fluoroplastic itself and a surface of the other side of the orifice plate attached to the main body is more hydrophilic than the bulk material. The surface of one side of the orifice plate made of the fluoroplastic and treated to become more water-repellent contains more fluorine atoms than are inherently present in the fluoroplastic in an untreated state.

8 Claims, 3 Drawing Sheets

RECORDING HEAD AND PROCESS FOR PRODUCING THE SAME

BACKGROUND OF THE INVENTION

This invention relates to the recording head of an ink-jet printer which uses a fluoroplastic orifice plate or an orifice plate having a fluoroplastic layer formed on the surface of a base, characterized in that the surface of either type of orifice plate is treated to become super-water-repellent, or treated to become more water-repellent than the water-repellent fluoroplastic bulk material. The invention also relates to a process for producing the recording head.

A typical process for producing the recording head of a thermal ink-jet printer comprises the steps of preparing a semiconductor device (the main body of the head) by forming a drive circuit and heaters (thin-film resistors) on a silicon substrate, opening ink supply holes through the silicon substrate from the back side and forming a cavity on each heater that serves as an ink chamber, attaching an orifice plate to the entire surface of the semiconductor device (the main body of the head), and opening each ink ejection orifice (nozzle) in a position corresponding to each heater.

It is known that the areas around the orifices in the recording head of an ink-jet printer (hereunder sometimes referred to as an ink-jet recording head) can generally be provided with consistent ink ejection characteristics by imparting water repellency. Therefore, in order to impart water repellency to the surface of the orifice plate, it has heretofore been attempted to coat the surface of the orifice plate with a fluoroplastic film, or implant ion molecules containing fluorine atoms into the surface of the orifice plate, or form tiny asperities on the surface of the orifice plate.

For instance, JP 6-316079 A discloses an ink-jet recording head in which the very limited areas peripheral to the ink ejection ports are coated with $C_2F_4^+$ ions by the method of inorganic Ion implantation to be rendered water-repellent. JP 10-151744 A discloses an ink-jet recording head in which tiny asperities with sizes of 10–100 nm are formed on the surface of an orifice plate such that not only its surface but also the inner surfaces of the orifices within a depth of 3 $\mu$m from the surface become water-repellent.

Therefore, from the viewpoint of water repellency, it is preferred to use a fluoroplastic orifice plate or an orifice plate having a fluoroplastic layer formed on the surface of a base. However, fluoroplastics inherently have high level of water repellency and very poor adhesion, so it has been extremely difficult to attach the orifice plate to the semiconductor device or form mask materials such as photoresist and metal mask on the orifice plate before opening (boring) orifices.

SUMMARY OF THE INVENTION

The present invention has been accomplished under these circumstances and has an object providing a recording head which uses a fluoroplastic orifice plate or an orifice plate having a fluoroplastic layer on the surface and which is characterized in that the surface of either type of orifice plate is treated to become super-water-repellent.

Another object of the invention is to provide a process for producing the recording head.

In order to attain the object described above, the first aspect of the present invention can also be described as a recording head of an ink-jet printer which comprises a main body having ink ejection devices and a device for driving the ink ejection devices independently, and an orifice plate the other side of which is attached to the main body and which has ink ejection orifices opened in the positions corresponding to the ink ejection devices, the orifice plate having at least one side formed of a fluoroplastic, the surface of the one fluoroplastic side having been treated to become more water-repellent than the bulk material of the fluoroplastic whereas the surface of the other side of the orifice plate is more hydrophilic than the bulk material of the fluoroplastic, and said more water-repellent surface of the one fluoroplastic side containing more fluorine atoms than are inherently present in the fluoroplastic in an untreated state.

Preferably, the orifice plate is composed of a fluoroplastic member and is such that the surface of the other side which is attached to the main body has been treated to become more hydrophilic than the bulk material in an interior of the fluoroplastic member whereas the surface of the one side has been treated to become more water-repellent than the bulk material and the more water-repellent surface layer of the fluoroplastic member contains more fluorine atoms than are inherently present in the bulk material in the interior of the fluoroplastic member in the untreated state.

Preferably, the orifice plate comprises a base which is more hydrophilic than the bulk material of the fluoroplastic itself at the other side of the orifice plate and a fluoroplastic layer formed on the base at the one side, a surface of the fluoroplastic layer having been treated to become more water-repellent than an interior of the fluoroplastic layer, and the surface of the fluoroplastic layer treated to become more water-repellent contains more fluorine atoms than are inherently present in the interior of the fluoroplastic layer in the untreated state.

In order to attain another object described above, the second aspect of the present invention can also be described as a process for producing a recording head of an ink-jet printer comprising the steps of preparing an orifice plate having at least one side formed of fluoroplastic, treating the surface of the one fluoroplastic side to become more hydrophilic than the bulk material of the fluoroplastic, attaching the other side of the orifice plate to the main body of a head having ink ejection devices and a device for driving the ink ejection devices, the other side being more hydrophilic than the bulk material of the fluoroplastic, forming on the one side of the orifice plate a mask for masking the regions of the orifice plate other than those corresponding to the ink ejection devices, using the mask to open ink ejection orifices in the orifice plate at the positions corresponding to the ink ejection devices, removing the mask, and implanting ions into the surface of the one fluoroplastic side of the orifice plate so that the surface is treated to become more water-repellent than the bulk material of the fluoroplastic.

Preferably, the orifice plate itself is made of the fluoroplatic, and the treating step to become more hydrophilic is a step of treating both sides of the orifice plate made of the fluoroplastic to become sore hydrophilic than the bulk material of the fluoroplastic.

Preferably, the orifice plate comprises a base which is more hydrophilic than the bulk material of the fluoroplastic itself at the other side of the orifice plate and a fluoroplastic layer formed on the base at the one side of the orifice plate, the treating step to become more hydrophilic is a step of treating a surface of the fluoroplastic layer formed at the one side of the orifice plate to become hydrophilic, the mask is formed on the fluoroplastic layer of the orifice plate, and the implanting step is a step of implanting ions into the surface of the fluoroplastic layer of the orifice plate so that the surface is treated to become more water-repellent than the interior of the fluoroplastic layer.

Preferably, the fluoroplastic layer is formed by applying a fluoroplastic coat to the base, vapor-phase deposition of a fluoroplastic film on the base, or bonding a fluoroplastic sheet to the base.

Preferably, the ions are implanted only into regions of a specified range including those where the ink ejection orifices are opened, with the other regions being masked by the mask.

PREFERRED EMBODIMENT OF THE INVENTION

The recording head of the invention and the process for producing it are described below in detail with reference to the preferred embodiment shown in the accompanying drawings.

Figure 1:
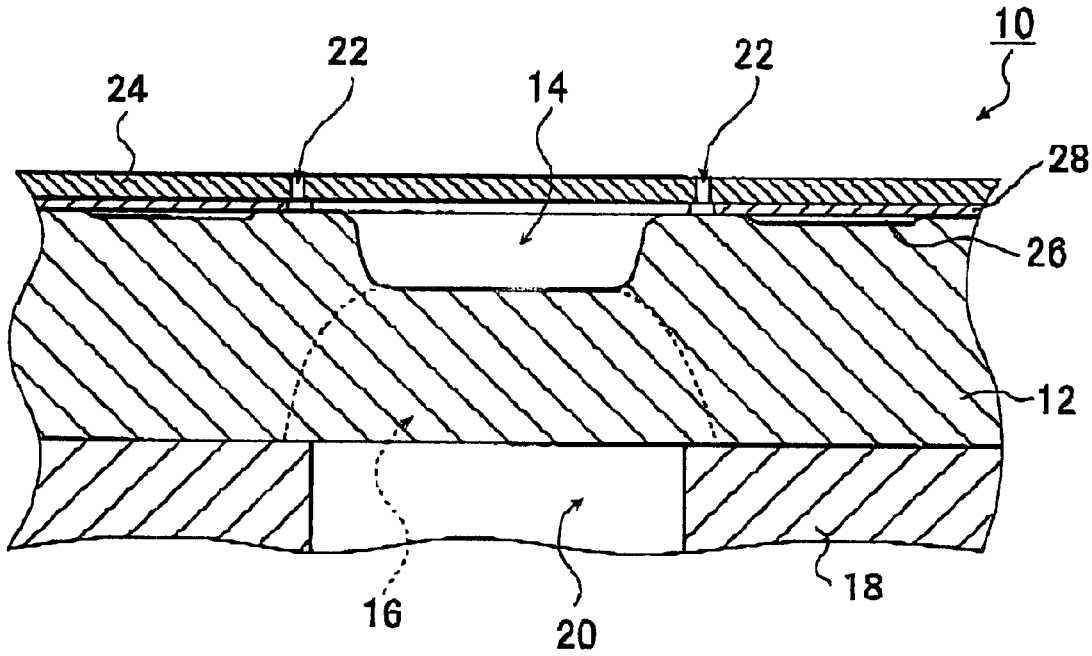
FIG. 1 shows in section an embodiment of the recording head of a thermal ink-jet printer according to the first aspect of the invention.

FIG. 1 shows in section an embodiment of the recording head of a thermal ink-jet printer according to the first aspect of the invention.

The recording head generally indicated by 10 in FIG. 1 is an embodiment of the recording head according to the first aspect of the invention that has been produced by the semiconductor fabrication technology using the process according to the second aspect of the invention. To fabricate the recording head 10, an ink channel 14 through which ink is supplied to an orifice (nozzle) serving as an ink ejection port is first made in the center of a semiconductor substrate such as a silicon substrate 12 by excavating the obverse surface of the silicon substrate 12 and this ink channel extends perpendicular to the paper on which FIG. 1 is drawn.

In order to supply ink to the ink channel 14, a plurality of ink supply holes (through-holes) 16 providing communication between the back side of the silicon substrate 12 and the ink channel 14 are opened a given spacing in the direction in which ink channel 14 extends. A support frame 18 is provided as a support member for proper placement of the silicon substrate 12. Ink channels 20 are formed in the support frame 18 to ensure that ink supplied from an ink tank (not shown) are fed via the ink supply holes 16 into the ink channel 14 formed in the obverse side of the silicon substrate 12.

On opposite sides of the ink channel 14, two orifice rows are formed in symmetrical positions, with each row consisting of a plurality of orifices 22 that are arranged at equal spacings along the ink channel 14. Each orifice 22 is in a hollow cylindrical form through-hole with a circular cross section) and made in an orifice plate 24 that is placed on top of the silicon substrate 12. For a resolution of 360 npi (nozzles per inch), orifices 22 are arranged perpendicular to the paper on a pitch of about 71 $\mu$m per row so that an overall resolution of 720 npi can be realized by two rows.

Figure 2:
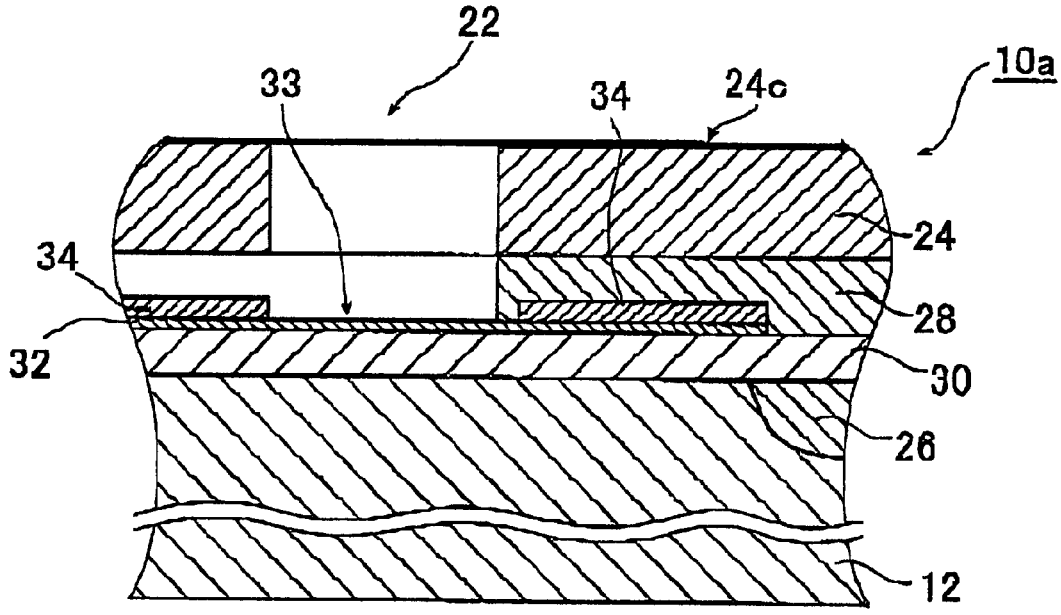
FIG. 2 shows in section an embodiment of the area around an orifice in the recording head of the invention.

FIG. 2 shows in detail an embodiment of the area around the orifice 22. As shown, the surface of the silicon substrate 12 is covered with an insulation film 30 such as a silicon oxide film. On top of the insulation film 30 is provided a thin-film resistor 32 serving as a heat-generating resistor; all areas of the thin-film resistor 32 except heat-generating resistors 33 corresponding to the positions of individual orifices 22 are overlaid with thin-film conductors 34 that serves as electrodes for supplying drive power to the respective heat-generating resistors 33; the thin-film conductors 34 connect the respective heat-generating resistors 33 with their drive circuits 26 to be described below. The heat-generating resistors 33 comprise ink ejection devices which controls ink ejection from the individual orifices 22.

As shown in FIG. 1, the drive circuits (drive units) 26 for driving the individual heat-generating resistors 33 are formed on the surface of the silicon substrate 12 in areas, with the ink channel 14 lying in between, which are outside the orifice rows. Between the surface of the silicon substrate 12 and the orifice plate 24, partitions 28 are formed to define an ink flow path through which ink is supplied from the ink channel 14 to each orifice 22.

In a thermal ink-jet printer using the recording head 10 shown in FIG. 1, ink from the ink tank flows through the ink channel 20 in the support frame 18 past the ink supply holes 16 opened in the silicon substrate 12, then supplied into the ink channel 14 in the surface of the silicon substrate 12; the ink then flows through the ink flow path defined by the partitions 28 and is distributed to the orifice rows formed on opposite sides of the ink channel 14. The individual heat-generating resistors 33 are controlled by the drive circuits 26 in accordance with image data and a predetermined amount of ink is delivered from the associated orifices 22.

The characterizing part of the recording head of the invention is described below.

FIG. 2 shows in section an embodiment of the area around an orifice in the recording head of the invention The figure shows schematically a section of the area around the orifice 22 in the recording head 10 shown in FIG. 1. In the recording head indicated by 10*a* in FIG. 2, the orifice plate 24 is fluoroplastic member and the surface 24*c* of its obverse side which is opposite the reverse side facing the semiconductor device comprising the main body of the recording head is rendered super-water-repellent so that it contains more fluorine atoms than the bulk material (untreated fluoroplastics) to exhibit a higher level of water repellency than the fluoroplastic in an untreated state.

In contrast, the reverse side of the orifice plate 24 is rendered hydrophilic so that it exhibits a sufficiently increased level of hydrophilicity than the bulk material (untreated fluoroplastics) to have improved adhesion to the semiconductor device (the main body of the head). The surface of the reverse side of the orifice plate 24 forms the ceiling of the ink flow path through which ink is supplied from the ink channel 14 to each orifice 22. The surface of the orifice plate 24 in the form of a fluoroplastic member is generally water-repellent and it is preferred to render the reverse side of the orifice plate 24 hydrophilic.

Figure 3:
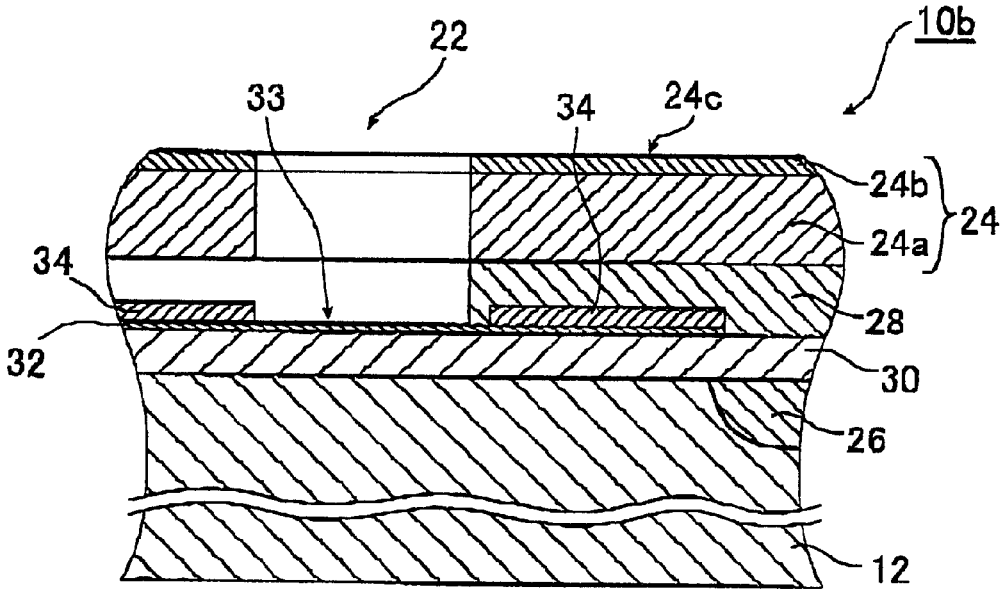
FIG. 3 shows in section another embodiment of the area around an orifice in the recording head of the invention.

FIG. 3 shows in section another embodiment of the area around an orifice in the recording head of the invention. In the recording head indicated by 10*b* in FIG. 3, the orifice plate 24 comprises a base 24*a* and a fluoroplastic layer 24*b* formed on the surface of its obverse side (top side in the figure); the surface of the reverse side of the base 24*a* (bottom side in the figure) is more hydrophilic than the fluoroplastic layer 24*b* (the bulk material or the untreated fluoroplastic of which the layer is made) and the surface 24*c* of the fluoroplastic layer 24*b* has been rendered super-water-repellent as in the embodiment shown in FIG. 2. The base 24*a* may be formed of any resin that is more hydrophilic than the bulk material (untreated fluoroplastics) and can be a film made of a variety of known resins such as acrylics, polyimides and aramids. The surface of the base 24*a* need not be rendered hydrophilic if has good enough adhesion to the main body of the head (semiconductor device, in particular, partitions 28 in the illustrated case), the fluoroplastic layer 24*b*, etc.

Thus, in the recording head 10 of the invention, the orifice plate 24 can typically be a fluoroplastic member, a plate solely made of a single fluoroplastic layer, or a member (plate) having a layered structure comprising at least the base 24*a* and the fluoroplastic layer 24*b* formed on its topmost surface.

Materials for the fluoroplastic member or the fluoroplastic layer 24*b* can be selected from among various known types of fluoroplastics including fluorocarbon resins that contain —$CF_2$— in the main chain and have —$CF_3$ in terminal groups, fluorosilicone resins that contain —$SiF_2$— in the main chain and have —$SiF_3$— in terminal groups, hydrofluorocarbon or hydrofluorosilicone resins that have part of the fluorine atoms in such fluorocarbon or fluorosilicone resins replaced by hydrogen atoms.

More specific examples of the materials for the fluoroplastic member or the fluoroplastic layer include fluoroplastics such as PTFE [poly(tetrafluoroethylene)], PFA (tetrafluoroethylene-perfluoroalkyl vinyl ether copolymer), FEP (tetrafluoroethylene-hexafluoropropylene copolymer) and ETFE (tetrafluoroethylene copolymer). Among these, PTFE can be mentioned as a particularly preferred example.

The term "super-water-repellency" as used in the invention refers to a property of a surface having a larger contact angle with water than the surfaces of commonly known bulk materials Of the various bulk materials known today, PFA resins have the largest contact angle which is about 115 degrees and super-water-repellency is a property of surfaces having larger contact angles. Therefore, in the invention, treating the surface of the fluoroplastic member or the fluoroplastic layer to become super-water-repellent means treating the surfaces of fluoroplastic such that they become more water-repellent or have larger contact angles than before they were treated.

To be more specific, In the invention, the contact angle with water of super-water-repellent surfaces is at least 120 degrees and it may be at least 150 degrees, or even at least 170 degrees or more. There is no particular limitation on the upper limit of the contact angle with water.

The treatments that can be used in the invention to render the surfaces or the fluoroplastic member and the fluoroplastic layer super-water-repellent are not limited in any particular way and any treatments will do if they can impart super-water-repellency to the surfaces of fluoroplastics. To mention just two examples, one may employ the methods described in detail in prior art references such as JP 2000-17091 titled "shaped fluoroplastics having a modified surface layer, a method and an apparatus for surface treatment of fluoroplastics" and "Effects of Ar ion implantation on the treatment of fluoroplastics for rendering them super-water-repellent" in the collection of preprints for the 15th Symposium on Ion Implantation as Surface Layer Treatment.

The treatments that can be used in the invention to provide hydrophilic surfaces are not limited in any particular way and any treatments will do if they can impart hydrophilicity to the surfaces of fluoroplastics. To mention just one example, one may employ the methods described in detail in prior art references such as "The Cutting Edge of Surface Modification Technology for Fluoroplastics" in Nitto Giho, vol. 34, No. 1 <May 1996>.

Figure 4:
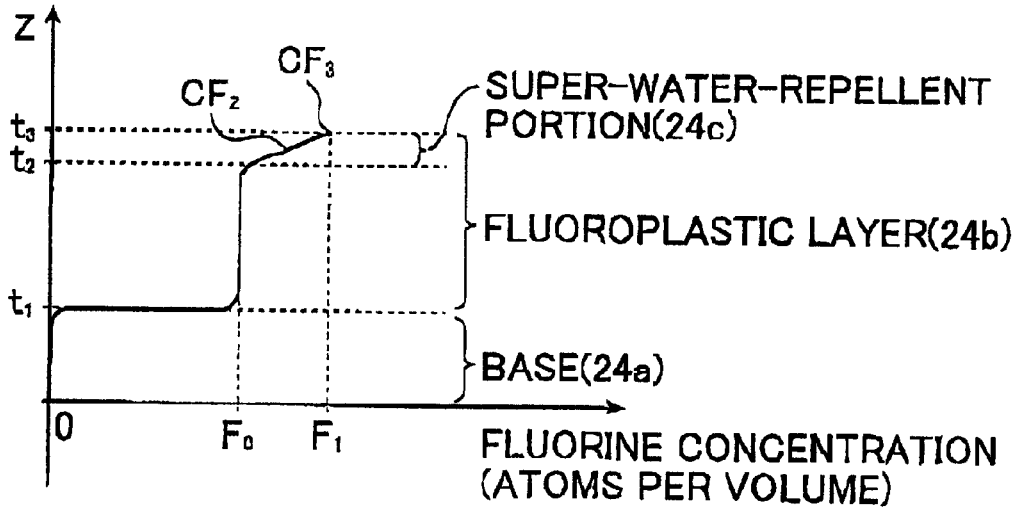
FIG. 4 is a graph showing diagrammatically the concentration profile of fluorine atoms in the surface of a fluoroplastic layer that has been rendered super-water-repellent to make the orifice plate of the recording head of the invention.

Thus, as shown in FIG. 4, the fluoroplastic member or fluoroplastic layer that have been treated to become super-water-repellent contain more fluorine atoms in the topmost part than the untreated fluoroplastic member or fluoroplastic layer (the bulk material in the interior).

FIG. 4 is a graph showing diagrammatically the concentration profile of fluorine atoms in the surface of a fluoroplastic that was treated to become super-water-repellent. The vertical axis of the graph in FIG. 4 plots the thickness of the orifice plate 24 shown in FIG. 3, with the origin set at a point in the base 24*b* and the thickness increasing toward the surface of the orifice plate. The horizontal axis of the graph plots the concentration of fluorine (F) atoms in the number of atoms per volume.

In FIG. 4, the thickness range from 0 to $t_1$ represents the base 24*a* and in this range, the concentration of F atoms is zero; in the range from $t_1$ to $t_2$, the concentration of F atoms is $F_0$ which fluoroplastics (bulk material) inherently have; in the topmost part 24*c* of the fluoroplastic layer 24*b* ranging from $t_2$ to $t_3$ in thickness, the concentration of F atoms increases with a given gradient from the inherent value $F_0$ to $F_1$, indicating that the portion 24*c* has been rendered super-water-repellent. The value $F_0$ as the inherent concentration of F atoms in fluoroplastics indicates the concentration of F atoms in a material chiefly composed of —$CF_2$— and $F_1$ indicates the concentration of F atoms essentially corresponding to the terminal —$CF_3$ groups in the topmost part of the fluoroplastic layer.

Preferably, the fluoroplastic member or layer thus treated to become super-water-repellent has asperities formed in the surface to give a center-line-average roughness index Ra of 0.2–3 $\mu$m; the asperities are preferably an array of tiny projections whose number ranges from $2.6\times10^{13}$ to $1.8\times10^{10}$ per square meter. Forming such asperities contributes to further enhancing the super-water-repellency (further increasing the contact angle) of the surface of the fluoroplastic member or layer.

Figure 5:
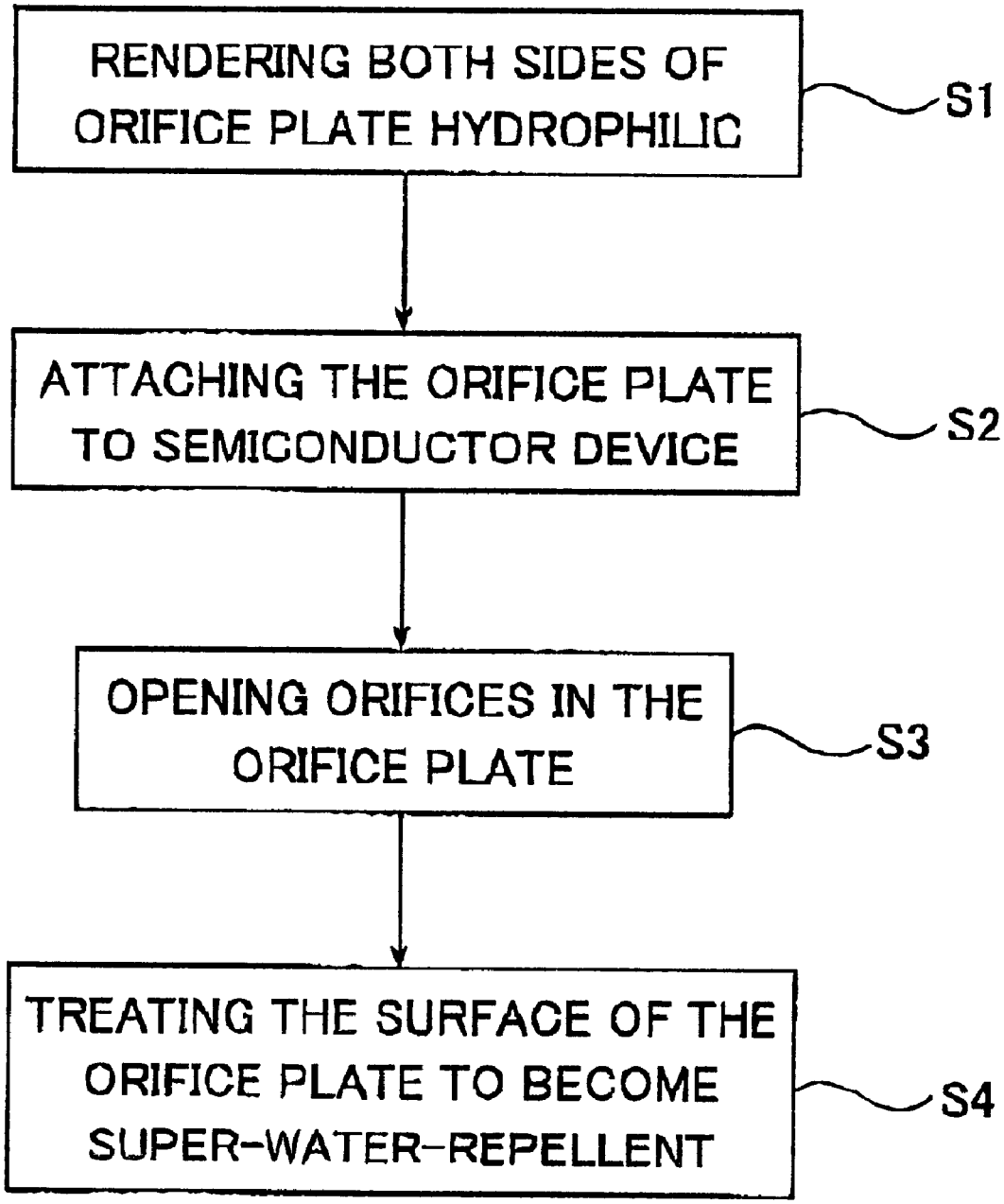
FIG. 5 is an exemplary flowchart for the steps in the process for producing a recording head according to the second aspect of the invention.

We next describe the process for producing the recording head of the invention with reference to the flowchart in FIG. 5 for the case of using PTFE as a material for the fluoroplastic member or layer.

If the orifice plats 24 is a fluoroplastic member made of PTFE, the first step is rendering both sides of the orifice plate 24 hydrophilic (S1 in the flowchart). Plasma discharge can be mentioned as a preferred example of the treatment for rendering the surface of the PTFE member hydrophilic. Methods of rendering the surface of the PTFE member hydrophilic are not limited at all and various known methods can be adopted including the methods described in "The cutting Edge of Surface Modification Technology for Fluoroplastics" in Nitto Giho, vol. 34, No. 1 <May 1996>, supra.

Since the hydrophilized surface of the orifice plate 24 has better adhesion, not only is it easy to attach the orifice plate 24 to the main body of the head (the semiconductor device, in particular, the partitions 2*a*), it is also easy to form a mask on the orifice plate 24 using a mask material before opening orifices 22.

Subsequently, partitions 28 are formed on the surface of the semiconductor device on which the heat-generating resistors 33 and their drive circuits 26 have been formed and the orifice plate 24 is attached to the partitions 28 (S2). Then the regions of the orifice plate 24 other than those corresponding to the heat-generating resistors 33 are masked using a mask pattern formed of a mask material such as a photoresist, and dry etching or other suitable technique is performed to open ink ejection orifices 22 in the orifice plate 24 at the positions corresponding to the heal-generating resistors 33 (33). The photoresist is removed after opening the orifices 22.

Finally, ions are implanted into the surface of the orifice plate 24 to impart super-water-repellency (S4). To impart super-water-repellency by ion implantation, various known methods can be adopted including the methods described in JP 2000-17091 titled "shaped fluoroplastics having a modified surface layer, a method and an apparatus for surface treatment of fluoroplastics" and "Effects of Ar ion implantation on the treatment of fluoroplastics for rendering them super-water-repellent" in the collection of preprints for the 15th Symposium on Ion Implantation as Surface Layer Treatment, supra.

It should, however, be stressed that the ion implantation based methods of treatment for imparting super-water-repellency which are described in the above-mentioned references are for treating ordinary fluoroplastic surfaces, namely, untreated fluoroplastic surfaces, to have super-water-repellency. The present inventors for the first time found that those methods were also effective with hydrophilized fluoroplastic surfaces and confirmed their effectiveness; the Inventors then applied those methods to the ink-jet recording head to achieve outstanding results.

To be more specific, the surface of the PTFE orifice plate 24 in the form of a fluoroplastic member can be implanted with Ar ions at an acceleration voltage of 2–50 kV in a dose of $1\times10^{13}$–$1\times10^{16}$ ions per square centimeter. As a result, the surface of the orifice plate 24 acquires super-water-repellency.

The ions to be implanted into the orifice plate 24 are by no means limited to Ar and other ions such as Ne, He, F and N may also be applied. If the dose of ion implantation exceeds a certain level, the performance in imparting super-water-repellency tends to become saturated, so the above-stated range of dose is recommended.

By rendering the surface of the orifice plate 24 super-water-repellent, namely, by implanting Ar ions into the PTFE surface in the embodiment under consideration, the chains (bonds) in the PTFE are cleaved and $CF_3$ groups with smaller surface energy are generated to develop super-water-repellency. To be more specific, part of the chains at the terminal of $—CF_2—$ or near the surface layer is cleaved to generate terminal groups such as $—CF_2—CF_3$, $—CF_2CF—(CF_3)_2$ and $—CF_2—C\equiv(CF_3)_3$.

By rendering the surface of the orifice plate 24 super-water-repellent, it can be prevented from being stained by ink. In the recording heads of conventional ink-jet printers, a negative pressure of about 0.1 atmosphere is established within the ink tank in order to prevent ink leakage from orifices. This is not the case with the recording head of the invention which has the surface of the orifice plate rendered super-water-repellent and no ink leakage will occur even if the interior of the ink tank is held at atmospheric pressure. Hence, there is no need to use a negative pressure generator in the invention.

We now discuss the case where the orifice plate 24 comprises the base 24*a* and the fluoroplastic layer 24*b* formed on the surface of either one side of it. In the first step, the surface of the orifice plate 24 on the side where the fluoroplastic layer 24*b* is formed is rendered hydrophilic.

Thereafter, the partitions 28 are formed on the surface of the semiconductor device on the side where the heat-generating resistors 33 and their drive circuits 26 have been formed and the other side of the orifice plate 24, namely, the side of the base 24*a* where the fluoroplastic layer 24*b* is not formed, is attached to the partitions 28.

In this case, if the surface of the base 24*a* has good enough adhesion, the orifice plate 24 can be easily attached to the semiconductor device without rendering the surface of the base 24*a* hydrophilic. If the surface of the bass 24*a* has only poor adhesion, it may be rendered hydrophilic before the orifice plate 24 is attached to the semiconductor device. In other words, using the base 24*a* having good surface adhesion is preferred since this eliminates the need to render the surface of the base 24*a* hydrophilic when the fluoroplastic layer 24*b* is formed on its surface or before it is attached to the main body of the head (to the surface of the semiconductor device via the partitions 28).

The subsequent treatments are the same as in the case of using a PTFE member as the orifice plate 2A The fluoroplastic layer 24*b* can be formed by various methods including the application of a fluoroplastic coat to the base 24*a*, super-phase deposition of fluoroplastic films on the base 29*a* such as by sputtering, vacuum evaporation and CVD, and bonding of fluoroplastic sheets to the base 24*a*. In the above-described two cases, one where the orifice plate 24 is a fluoroplastic member and the other case where it has a layered structure having at least the base 24*a* and the overlying fluoroplastic layer 24*b*, the treatment for rendering the surface of the orifice plate 24 super-water repellent may be applied only to the regions of a specified range including those where the orifices 22 are opened, with the other regions being properly masked.

The invention is applicable to the recording heads of both monochromatic and full-color thermal ink-jet printers which are of such a construction that the orifice plate 24 is attached to semiconductor devices. While various constructions are known for the recording heads including the top shooter type (face ink-jet) and the side shooter type (edge ink-jet), all of them can be used in the invention. Orifices can be arranged in any desired number of rows and there is no limitation on the number of recording elements that can be provided.

In the embodiment described above, the concept of the invention is applied to the recording head of a thermal ink-jet printer which ejects ink upon heating. However, this is not the sole case of the invention and the claimed recording head is applicable to all other known types of ink-jet printer including the pressure type which ejects ink by vibrating the diaphragm with the aid of a piezoelectric device or under static electric force. In the invention, the heat-generating resistors used in the thermal type as well as the piezoelectric device and the like that are used in the pressure type are collectively referred to as the ink ejection devices.

The description in the foregoing embodiment is directed to the case where a semiconductor device having the heat-generating resistors 33 as the ink ejection devices and the circuits for driving them as well is used as the main body of the recording head. This is not the sole case of the invention and the main body of the recording head may be composed of non-semiconductor devices. The main body of the recording head needs only to have the ink ejection devices and its drive circuit; as long as this requirement is met, the ink ejection devices and its drive circuit may be formed in an integral unit as in the case of the semiconductor device according to the above-described embodiment; alternatively, they may be interconnected after being formed separately in the main body of the recording head.

Described above are the essential features of the invention.

While the recording head of the invention and the process for its production have been described above in detail, it goes without saying that the invention is by no means limited to the foregoing embodiment and various improvements and modifications can be made without departing from the spirit and scope of the invention.

As described above in detail, the process of the present invention for producing the improved recording head comprises the steps of hydrophilizing both sides of an orifice plate in the form of a fluoroplastic member or the surface of a fluoroplastic layer formed on the surface of either one side of a base to make an orifice plate, attaching either type of the orifice plate to the main body of the recording head, opening ink ejection orifices in the orifice plate at the positions corresponding to the ink ejection devices, and implanting ions into the surface of the orifice plate to render the outside surface of the orifice plate super-water-repellent.

As a result, the invention can of course prevent the outside surface of the orifice plate from being stained with ink; in addition, the cost of the recording head can be reduced since the ink tank can be used with its internal pressure kept atmospheric

What is claimed is:

1. A recording head of an ink-jet printer comprising:

a main body having ink ejection devices and a device for driving said ink ejection devices independently; and an orifice plate that is attached to said main body and which has ink ejection orifices opened in positions corresponding to said ink ejection devices; wherein at least one side of said orifice plate is made of fluoroplastic, a surface of one side of said orifice plate which is made of the fluoroplastic has been treated to become more water-repellent than a bulk material of the fluoroplastic itself and a surface of the other side of said orifice plate which is attached to said main body is more hydrophilic than said bulk material of the fluoroplastic; and said surface of said one side of said orifice plate made of the fluoroplastic and treated to become more water-repellent contains more fluorine atoms than are Inherently present in the fluoroplastic in an untreated state.

2. The recording head according to claim 1, wherein said orifice plate is composed of a fluoroplastic member and is such that the surface of said other side which is attached to said main body has been treated to become more hydrophilic than the bulk material in an interior of said fluoroplastic member whereas the surface of said one side has been treated to become more water-repellent than said bulk material, and said more water-repellent surface layer of the fluoroplastic member contains more fluorine atoms than are inherently present in said bulk material in the interior of said fluoroplastic member in the untreated state.

3. The recording head according to claim 1, wherein said orifice plate comprises a base which is more hydrophilic than said bulk material of said fluoroplastic itself at said other side of the orifice plate and a fluoroplastic layer formed on said base at said one side, a surface of said fluoroplastic layer having been treated to become more water-repellent than an interior of said fluoroplastic layer, and said surface of said fluoroplastic layer treated to become more water-repellent contains more fluorine atoms than are inherently present in said interior of said fluoroplastic layer in the untreated state.

4. A process for producing a recording head of an ink-jet printer comprising the steps of:

preparing an orifice plate at least one side of which is made of fluoroplastic;

treating said at least one side of said orifice plate made of the fluoroplastic to become more hydrophilic than a bulk material of said fluoroplastic itself;

attaching the other side of said orifice plate which is more hydrophilic than said bulk material of the fluoroplastic itself to a main body of said recording head having ink ejection devices and a device for driving said ink ejection devices;

forming on one side of said orifice plate made of the fluoroplastic a mask for masking regions of said orifice plate other than those corresponding to said ink ejection devices;

opening ink ejection orifices in said orifice plate at positions corresponding to said ink ejection devices by using said mask;

removing said mask; and implanting ions into a surface of said one side of said orifice plate made of the fluoroplastic so that said surface of said one side is treated to become more water-repellent than said bulk material of said fluoroplastic itself.

5. The process according to claim 4, wherein said orifice plate itself is made of the fluoroplatic, and said treating step to become more hydrophilic is a step of treating both sides of said orifice plate made of the fluoroplastic to become more hydrophilic than said bulk material of said fluoroplastic.

6. The process according to claim 4, wherein said orifice plate comprises a base which is more hydrophilic than said bulk material of said fluoroplastic itself at said other side of said orifice plate and a fluoroplastic layer formed on said base at said one side of said orifice plate, said treating step to become more hydrophilic is a step of treating a surface of said fluoroplastic layer formed at said one side of said orifice plate to become hydrophilic, said mask is formed on said fluoroplastic layer of said orifice plate, and said implanting step is a step of implanting ions into the surface of said fluoroplastic layer of said orifice plate so that said surface is treated to become more water-repellent than the interior of said fluoroplastic layer.

7. The process according to claim 6, wherein said fluoroplastic layer is formed by applying a fluoroplastic coat to said base, vapor-phase deposition of a fluoroplastic film on said base, or bonding a fluoroplastic sheet to said base.

8. The process according to claim 4, wherein said ions are implanted only into regions of a specified range including those where said ink ejection orifices are opened, with the other regions being masked by said mask.

* * * * *